US008727303B2

(12) United States Patent
Araujo et al.

(10) Patent No.: US 8,727,303 B2
(45) Date of Patent: May 20, 2014

(54) VARIABLE BORE PACKER FOR A BLOWOUT PREVENTER

(75) Inventors: Raul Araujo, Houston, TX (US); Alexander Michael McAuley, Houston, TX (US); Reza H. Zonoz, Sugar Land, TX (US)

(73) Assignee: Cameron International Corporation, Houston, TX (US)

( * ) Notice: Subject to any disclaimer, the term of this patent is extended or adjusted under 35 U.S.C. 154(b) by 503 days.

(21) Appl. No.: 12/863,253

(22) PCT Filed: Jan. 30, 2009

(86) PCT No.: PCT/US2009/032655

§ 371 (c)(1),
(2), (4) Date: Jul. 16, 2010

(87) PCT Pub. No.: WO2009/099946

PCT Pub. Date: Aug. 13, 2009

(65) Prior Publication Data

US 2010/0294482 A1 Nov. 25, 2010

Related U.S. Application Data

(60) Provisional application No. 61/025,583, filed on Feb. 1, 2008.

(51) Int. Cl.
*E21B 33/06* (2006.01)

(52) U.S. Cl.
USPC ..... 251/1.1; 251/1.2; 251/1.3; 166/85.4; 166/363; 166/364

(58) Field of Classification Search
USPC ..... 251/1.1, 1.2, 1.3; 166/85.4, 363, 364
See application file for complete search history.

(56) References Cited

U.S. PATENT DOCUMENTS

| | | | | |
|---|---|---|---|---|
| 4,506,858 | A * | 3/1985 | Gentry | 277/325 |
| 4,553,730 | A * | 11/1985 | Vicic | 251/1.3 |
| 4,631,309 | A * | 12/1986 | Thormer et al. | 524/426 |
| 4,986,511 | A * | 1/1991 | Irby et al. | 251/1.3 |
| 5,713,581 | A * | 2/1998 | Carlson et al. | 277/325 |
| 6,089,526 | A | 7/2000 | Olson | |
| 6,367,804 | B1 | 4/2002 | Watts | |
| 6,955,357 | B2 * | 10/2005 | Griffin et al. | 277/325 |
| 2004/0021269 | A1 | 2/2004 | Gaudette et al. | |
| 2010/0140516 | A1 * | 6/2010 | Butuc | 251/1.1 |

OTHER PUBLICATIONS

PCT/US2009/032655 International Search Report and Written Opinion dated Aug. 21, 2009.

* cited by examiner

*Primary Examiner* — John K Fristoe, Jr.
*Assistant Examiner* — Daphne M Barry
(74) *Attorney, Agent, or Firm* — Chamberlain Hrdlicka

(57) ABSTRACT

A variable bore packer used in a blowout preventer to form a seal against different diameter tubular members for oil and gas drilling operations. The variable bore packer includes a packer member molded of elastomeric material with certain mechanical properties and including an inside curved surface. The packer also includes a plurality of packer inserts molded within the packer member to form an insert array. Additionally, the packer includes a protrusion extending from and bonded to the packer member inside curved surface, the protrusion including increased mechanical properties compared to the packer member. The packer member, the insert array, and the protrusion are molded into a unitary structure and sized to form a seal against the different diameter tubular members upon closure of the blowout preventer. Also, the insert array and the protrusion diminishing extrusion of the elastomeric material between the packer inserts and the tubular members.

18 Claims, 7 Drawing Sheets

SECTION A-A

VARIABLE BORE PACKER FOR A BLOWOUT PREVENTER

CROSS-REFERENCE TO RELATED APPLICATIONS

This application is a 35 U.S.C. §371 national stage application of PCT/US2009/032655 filed 30 Jan. 2009, which claims the benefit of U.S. Provisional Patent Application No. 61/025,583 filed 1 Feb. 2008, both of which are incorporated herein by reference in their entireties for all purposes.

STATEMENT REGARDING FEDERALLY-SPONSORED RESEARCH OR DEVELOPMENT

Not applicable.

BACKGROUND

Ram-type and annular BOPs are part of a pressure control system used in oil and gas drilling operations to control unexpected well bore pressure spikes or "kicks" as they are commonly referred to in the industry. Well bore kicks can cause the well bore pressure to reach several thousand pounds per square inch during a kick and can cause severe equipment damage as well as physical harm.

The ram-type BOP has a body with a vertical bore and a pair of laterally disposed opposing bonnet assemblies. Each bonnet assembly includes a piston which is laterally moveable within the bonnet assembly by pressurized hydraulic fluid. Replaceable sealing elements called "packers" are mounted within rams attached to the ends of the pistons which extend into the BOP bore. When these pistons are moved to a closed position, commonly referred to as "closing the BOP" or "closing the rams," the vertical bore of the BOP is sealed and the kick is contained. These packers are available in a variety of configurations designed to seal the BOP bore when the opposing rams and pistons are moved to their closed position. For a ram-type packer, each ram packer typically has a semicircular opening in its front face to form a seal around 180° of the outer periphery of the pipe. When the rams are closed, the opposing ram packers meet and seal the entire 360° periphery of the pipe.

The annular BOP utilizes a hemispherical piece of rubber usually reinforced with inserts. Unlike a ram-type BOP which closes with a horizontal motion, an annular BOP closes inward around the drill string in a smooth simultaneous upward and inward motion to seal on the pipe or the open hole. The geometry of this movement reduces internal stresses and friction between the BOP body and the sealing element, which translates into a longer field life with less maintenance. The annular design may also operate with a much lower operating pressure, reducing the number of hydraulic accumulators necessary, and thereby reducing cost and complexity of the BOP.

Packers that can be used for either a ram-type or annular BOP can be designed to seal around pipe of a specific size in the blowout preventer bore when the blowout preventer is closed. Other packers though may be configured to seal around a range of pipe sizes, and are referred to as variable bore packers. Both packers form a pressure tight seal during a kick until the well bore pressure can be controlled.

To form a proper seal with a variable bore BOP, the packer material must be of a low enough Durometer to close against the pipe and provide enough pressure for a range of pipe diameters. However, a low Durometer also tends to make the packer suffer from lack of support during the loading process. Increased Durometer packers may be used but more force is needed to form a seal, sometimes resulting in an inadequate seal due to incomplete closure and/or low pressure. Additionally, the increased Durometer packers may not be able to seal against as wide a range of pipe diameters. With both the ram-type and annular variable bore BOPs, the variable bore packer thus typically includes an annular or two semi-circular elastomeric sealing elements with an array of support inserts embedded in the elastomeric material. The inserts are molded within the elastomeric material in a pattern around the opening of the elastomeric material, forming unitary structure. The structure allows the plurality of packer inserts to move and seat against different diameter tubular members and also helps prevent extrusion of the elastomeric material between the packer inserts and the tubular member.

Even with inserts, however, some variable bore packers still have durability issues. Although inserts help prevent extrusion, the inserts are still configured and designed to adjust for sealing against different diameter pipes. Thus, the inserts still include gaps between the insert tips and the pipe being sealed against when the seal is actuated. When subject to load, the packer elastomeric material may still extrude through these small gaps, causing the packer material to tear and break apart and thus lose ability to form an adequate seal.

BRIEF DESCRIPTION OF THE DRAWINGS

For a more detailed description of the embodiments, reference will now be made to the following accompanying drawings:

FIG. 4 is a plan view of a pair of variable bore ram packers in the open position with a tubular member to be sealed against positioned in between.

FIG. 5 is a plan view of a pair of variable bore ram packers in the closed position sealing against a tubular member positioned in between.

DETAILED DESCRIPTION OF THE EMBODIMENTS

Figure 1:
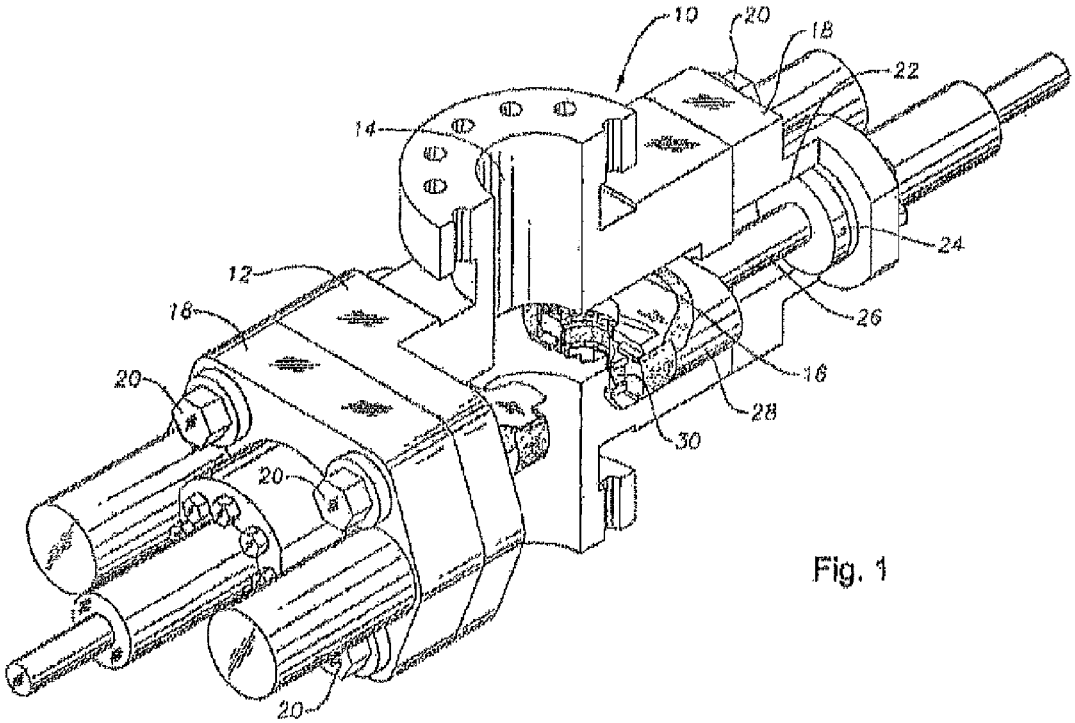
FIG. 1 is a perspective view illustrating a cutaway section of a typical ram-type blowout preventer used in oil and gas drilling operations with the variable bore ram packer of the present invention shown installed within.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect," "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

With reference to the drawings, and particularly to FIG. 1, an isometric view of a ram type BOP 10 used in oil and gas drilling operations is shown. Although a ram type BOP is shown and described, the BOP packer may also be used in an annular variable bore BOP in an annular configuration rather than two semi-circular halves. The ram type blowout preventer 10 includes a body or housing 12 with a vertical bore 14 and laterally disposed ram guideways 16. Bonnet assemblies 18 are mounted to the body 12 with suitable securing means such as studs or bolts 20 and aligned with laterally disposed guideways 16. Each bonnet assembly 18 includes an actuation means 22 that includes a piston 24 and connecting rod 26. While only one guideway 16 and actuation means 22 are shown, it is understood by those of ordinary skill in the art that there is a pair of opposed guideways 16 and actuation means 22. Each connecting rod 26 is connected to a ram 28 that includes a variable bore ram packer 30. The actuation means 22 allows the ram 28 and the variable bore ram packer 30 to be reciprocated within the guideways 16 or "opening and closing the rams" as it is referred to in the industry.

Figure 2:
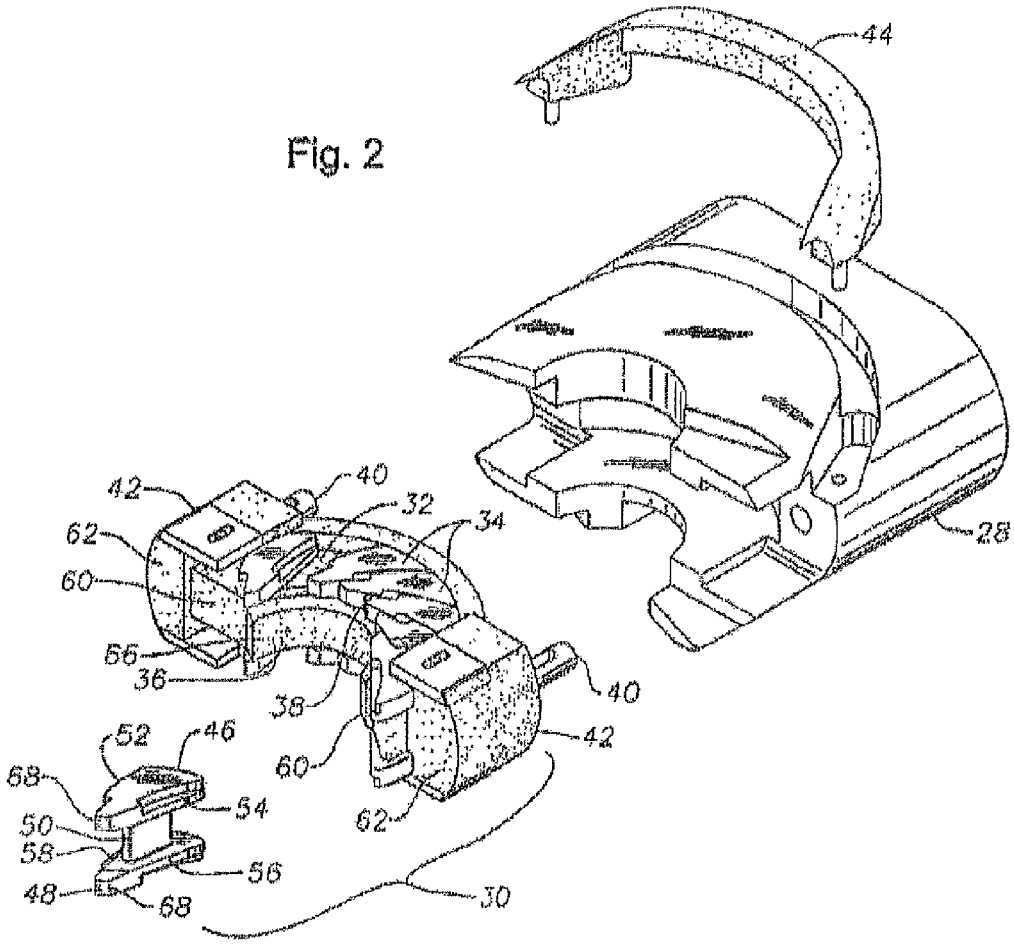
FIG. 2 is an exploded view of a variable bore ram packer.
Figure 2A:
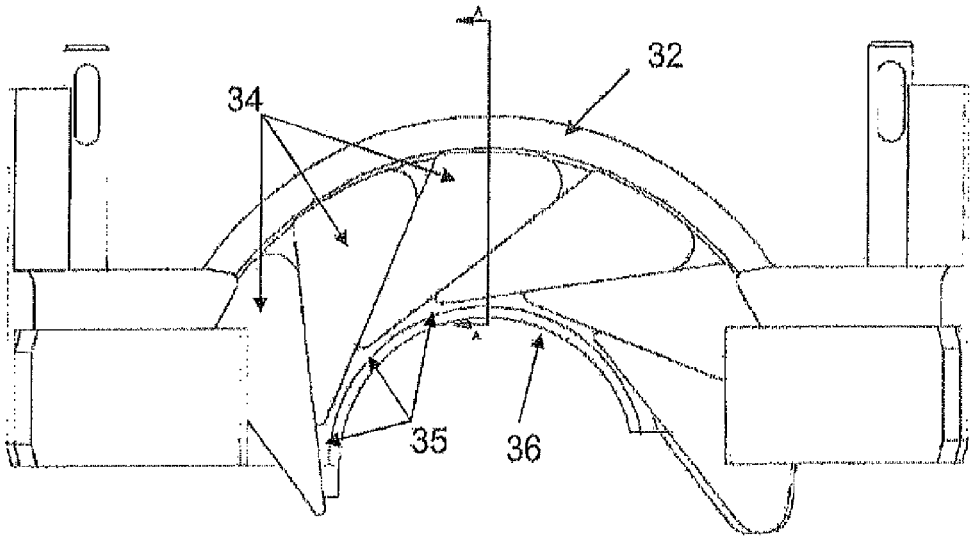
Figure 2B:
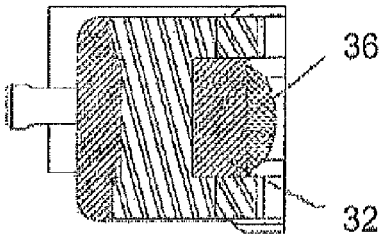

The variable bore ram packer 30 is shown in an exploded view in FIG. 2 to aid in understanding the relationship between the parts. The variable bore ram packer 30 includes a packer member 32 of an elastomeric material with suitable rheological characteristics. The packer 30 also includes packer inserts 34 molded into one unitary structure with the packer member 32 and arranged around a central semi-elliptical opening to form an insert array 38 that is sized to fit closely about a tubular member.

Packer pins 40 are molded into the packer 30 for connecting the packer 30 to the ram 28. The packer member 32 is molded to form side block seals 42 on its lateral edges. As best seen in FIG. 2, the packer member 32 is molded into a semi-elliptical shape with a sealing face 60 at each edge, adjacent the side block seals 42. On one side of each packer member 32, the sealing face 60 is inset, i.e., set back from the front face 62 of the packer member 32 or the parting line 64 between the opposing rams 28. The ram 28 includes a top seal 44 on its upper face. The top seal 44 and the side block seals 42 combine to seal the ram 28 in the guideways 16 of the BOP 10 in a manner well known to those of ordinary skill in the art.

As shown in FIG. 2, the packer inserts 34 include a top plate 46, a bottom plate 48, and a central web 50. The top plate 46 and the bottom plate 48 may be substantially triangular in shape with the central web 50 positioned thereon. The central web 50 is integrally formed with the top plate 46 and the bottom plate 48 by suitable means such as casting. Other means of forming the packer insert 34, such as attaching the central web 50 to the top plate 46 and the bottom plate 48 by welding, may also be used. The central web 50 is shown having a elongated rectangular cross section but differently shaped cross sections would be suitable provided they give sufficient bending strength to the packer insert 34.

The top plate 46 and the bottom plate 48 are mirror images of one another and include guide lip 52 and guide shoulder 54 formed on the top plate 46 and guide lip 56 and guide shoulder 58 formed on the bottom plate 48. Thus, when the packer inserts 34 are molded into the packer member 32, the guide lips 52 and the guide shoulders 54 of adjacent top plates 46 overlap. Similarly, the guide lips 56 and the guide shoulders 58 of adjacent bottom plates 48 overlap. Thus, as seen in FIG. 2, the assemblies of the top plates 46 and the bottom plates 48 are arranged to form semi-circular steel arcs similar to that of an "iris" shutter of a camera that acts to prevent extrusion of the elastomeric material of the packer member 32 under load.

Figure 2C:
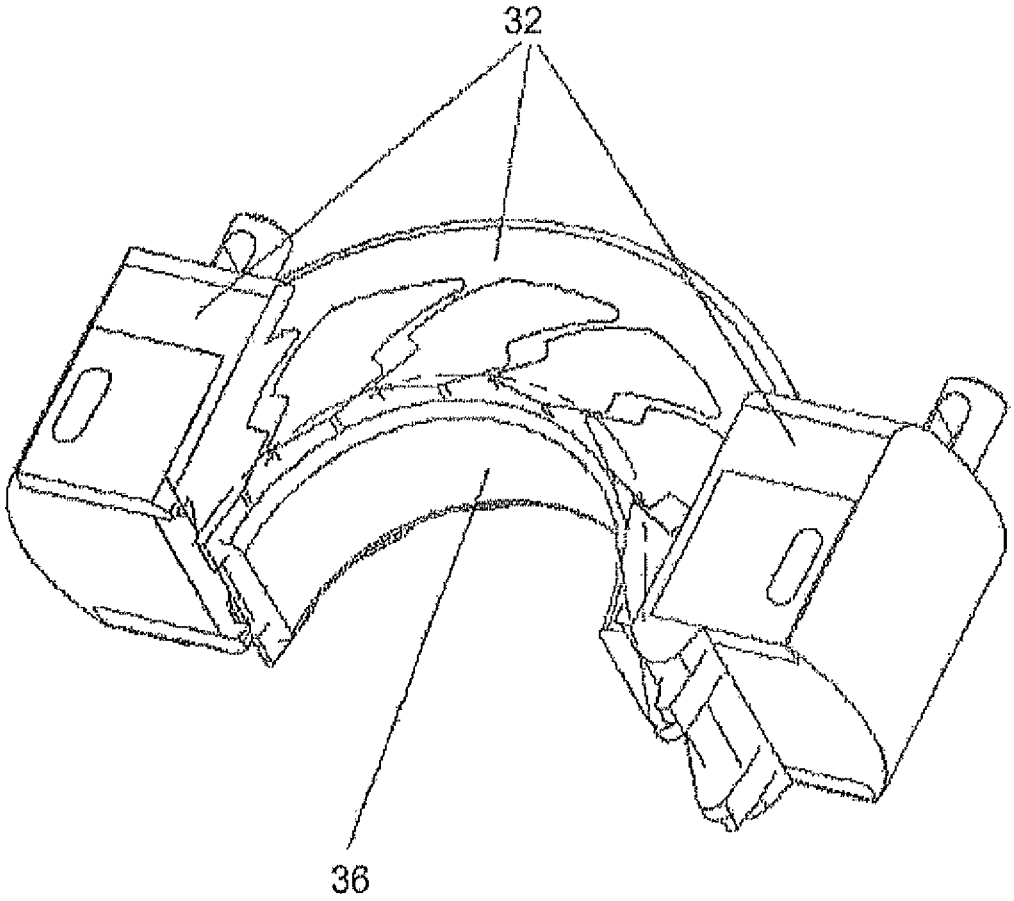

Although the inserts 34 work to prevent extrusion of the packer member 32, the top plate 46 and the bottom plate 48 include tips 68 at the apex of one side of their substantially triangular shape. These tips 68, while small, allow gaps 35 in the support provided by the inserts 34. To further support and prevent extrusion of the packer member 32 through the gaps, a protrusion 36 is therefore attached to the inside surface of the packer member 32. As best shown in FIGS. 2-2C, the protrusion 36 extends along the inside curved surface of the packer member 32 and includes a material with higher mechanical properties than the packer member 32. Thus, when subject to load, the protrusion 36 resists extrusion through the gaps formed between the inserts 34, thus minimizing loss of any packer material. Despite having different mechanical properties, the protrusion 36 is formed to the packer member 32 to prevent separation during operation. For example, the packer member 32 and the protrusion 36 may both include the same or similar elastomeric material such that the two may be vulcanized together. To change the mechanical properties of the protrusion 36, a filler material is embedded in and bonded to the elastomer of the protrusion 36, thus increasing mechanical properties such as tensile and shear strength as compared to the packer member 32. The filler material may include a fiber material filler such as fiberglass, KEVLAR®, carbon fiber, or the like. More than one filler may be used and the type and amount of filler embedded depends on the desired mechanical properties of the protrusion 36. With the protrusion 36 having increased mechanical properties, extrusion of the material through the gaps is diminished, thus diminishing deterioration of the packer 30 from being torn and broken apart. However, despite having increased mechanical properties of the protrusion 36, the packer 30 is still of a low enough Durometer to form an adequate seal for the desired range of pipe diameters. It should also be understood that other materials and methods may be used to form the protrusion 36 such that it maintains its connection with the packer member 32 and provides a material with increased mechanical properties.

Figure 3:
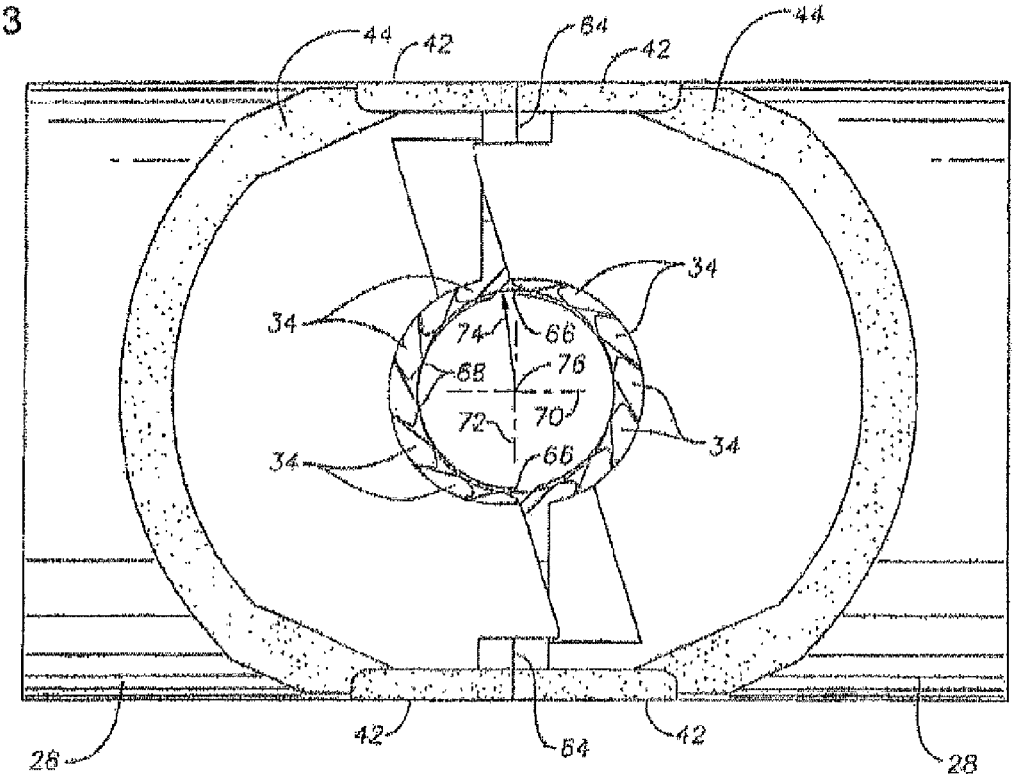
FIG. 3 is a plan view of a pair of variable bore ram packers in the closed position.

As shown in FIG. 3, the semi-elliptical shapes of packer members 32 are oriented with their major axis 70 aligned with the direction of movement of rams 28 as they are moved between open and closed positions. Similarly, the minor axis 72 of packer members 32 are oriented perpendicularly with the direction of movement of rams 28 and coincident with parting line 64. When packer members 32 are molded with packer inserts 34, packer inserts 34 are arranged as shown in FIG. 3, with tips 68 in a semi-circular arrangement with their radius 74 having as its center 76, the intersection of major axis 70 and minor axis 72 of packer members 32.

Figure 4:
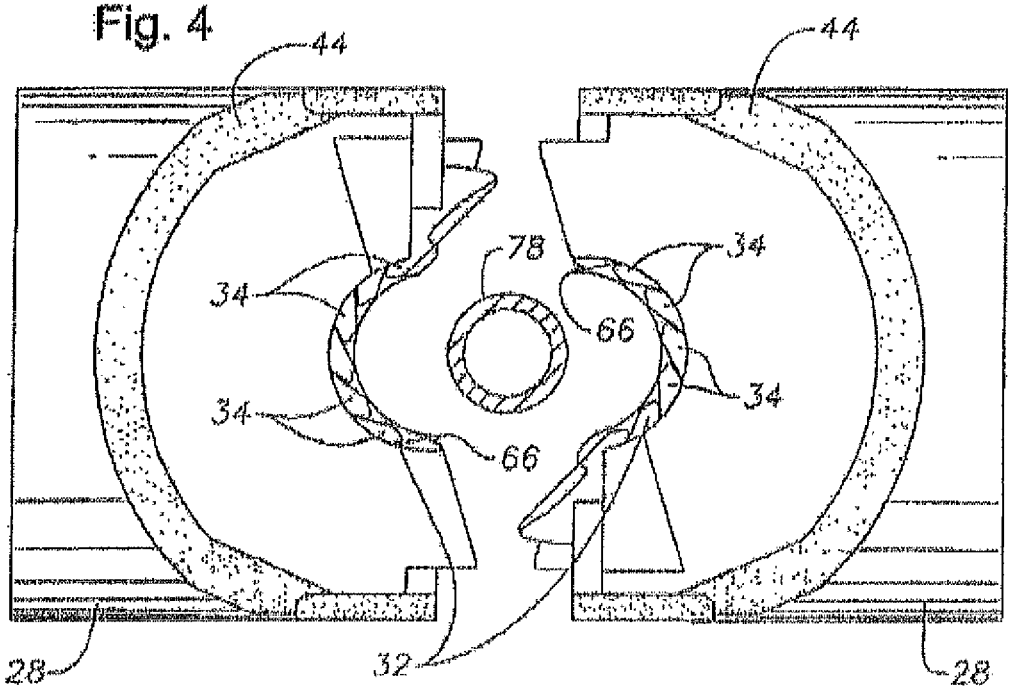
Figure 5:
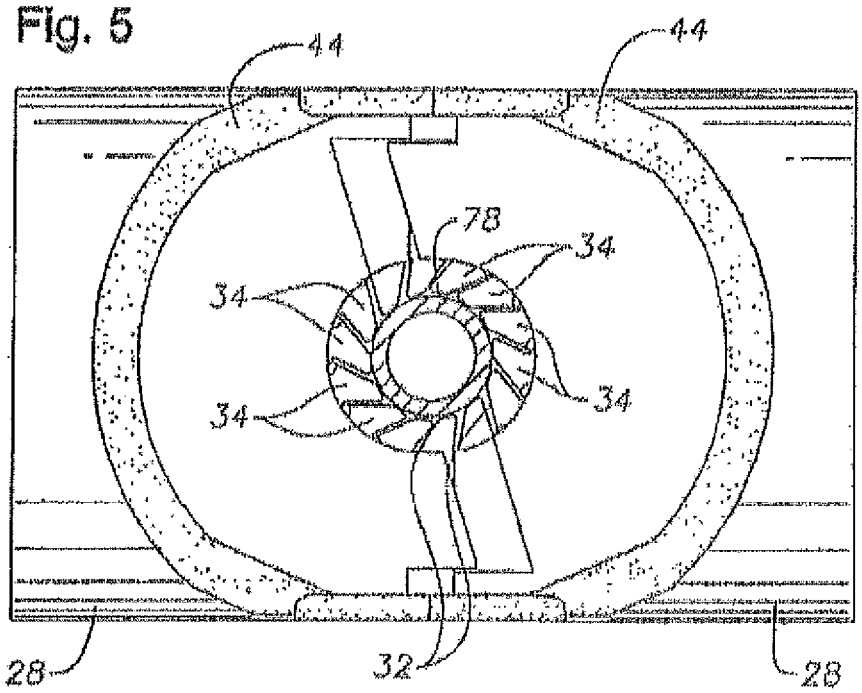
Figure 6A:
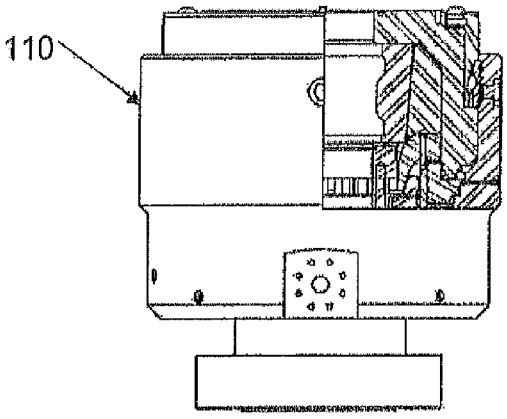
FIG. 6A is a partial cross section view of an embodiment of an annular variable bore blowout preventer.
Figure 6B:
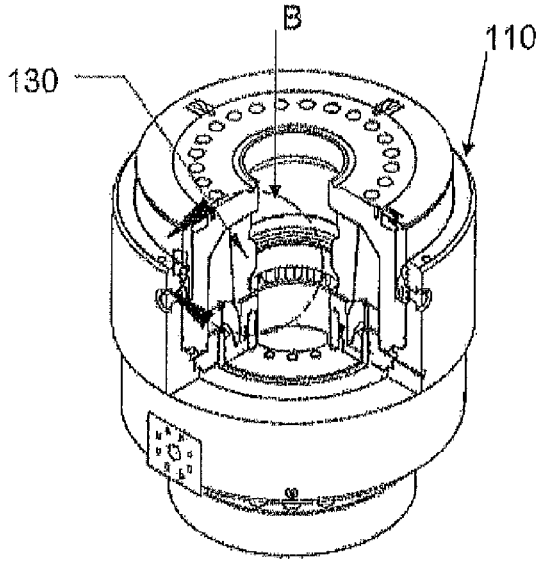
FIG. 6B is partial cut-out perspective view of the annular variable bore blowout preventer.
Figure 6C:
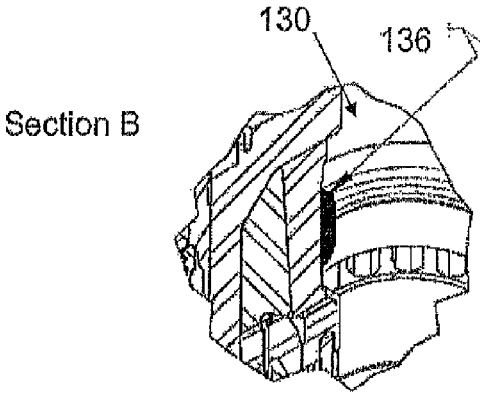
FIG. 6C is a partial cut-out perspective view of Section B from FIG. 6B.
Figure 6D:
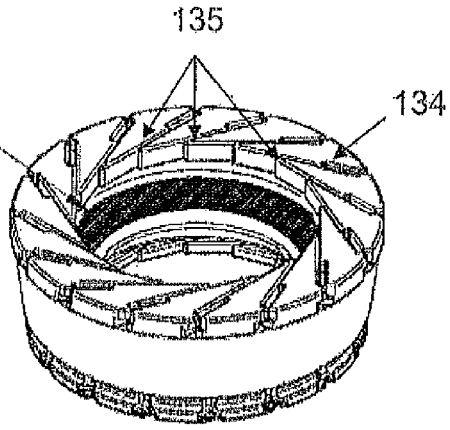
FIG. 6D is a perspective view of the packer used in the annular variable bore blowout preventer.

The sealing action of the BOP is seen more clearly in FIGS. 4 and 5 with drill pipe or similar tubular member 78 disposed between opposing rams 28. In the open position of FIG. 4, wedge protrusions 66 extend out from under the last packer insert 34 on opposite sides of packer members 32. Wedge protrusion 66 on each packer member 32 acts to engage the opposing ram packer 32 to provide a sliding action that reduces stress, elongation and strain in packer members 32 as packer members 32 are moved to their closed position of FIG. 5. Wedge protrusion 66 allows use of inset sealing face 60 which provides for engagement of packer inserts 34 prior to development of pressure in packer member 32.

Although the above discussion involves a ram-type variable bore BOP 10, the packer protrusion 36 is also suitable for use in an annular variable bore BOP 110 as shown by the annular variable bore packer 130 in FIGS. 6A-D. As shown, the annular packer 130 includes packer member 132 and embedded inserts 134. The packer member 132 also includes the protrusion 136 around the inside surface of the packer member 132. The protrusion 136 is similar to the protrusion 36 described above. Unlike the ram-type packer 30, the annular packer 130 is formed and acts as one unit to close and seal against the pipe shown in FIG. 6. However, the protrusion 136 prevents extrusion through the gaps 135 formed between the inserts 134 in a similar manner as described above for the packer 30.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A variable bore packer used in a blowout preventer to form a seal against different diameter tubular members for oil and gas drilling operations, including:

a packer member molded of elastomeric material and including an inside curved surface;

a plurality of packer inserts molded within the packer member to form an insert array;

a protrusion extending from and bonded to the packer member inside curved surface, the protrusion including a filler material different from the packer member material such that the protrusion has increased mechanical properties compared to the packer member including at least one of tensile strength and shear strength;

the packer member, the insert array, and the protrusion being molded into a unitary structure and sized to form a seal against the different diameter tubular members upon closure of the blowout preventer; and the insert array and the protrusion diminishing extrusion of the elastomeric material between the packer inserts and the tubular members upon closure of the blowout preventer.

2. The packer of claim 1, wherein the protrusion includes a fiber-embedded elastomer.

3. The packer of claim 2, wherein the fiber is selected from at least one of the group consisting of carbon fiber, synthetic fiber, and fiberglass.

4. The packer of claim 2, wherein the protrusion includes more than one type of fiber.

5. The packer of claim 1, wherein the packer member is semi-elliptical in shape.

6. The packer of claim 1, wherein the packer member is elliptical in shape.

7. The packer of claim 1, wherein the protrusion extends along the length of the packer member inside curved surface.

8. The packer of claim 1, wherein the packer member and the protrusion are formed together to prevent separation during operation of the blowout preventer.

9. The packer of claim 8, wherein the protrusion includes a fiber-embedded elastomer such that the protrusion and packer member are vulcanized together.

10. A blowout preventer for forming a seal against different diameter tubular members for oil and gas drilling operations, including:

a housing; and a variable packer including:

a packer member molded of elastomeric material and including an inside curved surface;

a plurality of packer inserts molded within the packer member to form an insert array;

a protrusion extending from and bonded to the packer member inside curved surface, the protrusion including a filler material different from the packer member material such that the protrusion has increased mechanical properties including at least one of tensile strength and shear strength compared to the packer member;

the insert array and the protrusion diminishing extrusion of the elastomeric material between the packer inserts and the tubular members upon closure of the blowout preventer; and the variable bore packer capable of forming a seal against different diameter tubular members for oil and gas drilling operations.

11. The blowout preventer of claim 10, wherein the protrusion includes a fiber-embedded elastomer.

12. The blowout preventer of claim 10 wherein the fiber is selected from at least one of the group consisting of carbon fiber, synthetic fiber, and fiberglass.

13. The blowout preventer of claim 11, wherein the protrusion includes more than one type of fiber.

14. The blowout preventer of claim 10, wherein the packer member is semi-elliptical in shape.

15. The blowout preventer of claim 10, wherein the packer member is elliptical in shape.

16. The blowout preventer of claim 10, wherein the protrusion extends along the length of the packer member inside curved surface.

17. The blowout preventer of claim 10, wherein the packer member and the protrusion are formed together to prevent separation during operation of the blowout preventer.

18. The blowout preventer of claim 17, wherein the protrusion includes a fiber-embedded elastomer such that the protrusion and packer member are vulcanized together.

* * * * *